United States Patent [19]

Oster

[11] Patent Number: 4,888,874

[45] Date of Patent: Dec. 26, 1989

[54] DRAWING DEVICE HAVING MOBILE STYLUS TRACING LINES ON GLASS PLATE

[75] Inventor: Francis Oster, Strasbourg, France

[73] Assignee: Buddy L Corporation, New York, N.Y.

[21] Appl. No.: 218,980

[22] Filed: Jul. 14, 1988

[30] Foreign Application Priority Data

Apr. 5, 1988 [FR] France ..... 88 04649

[51] Int. Cl.[4] ..... B43I 13/00

[52] U.S. Cl. ..... 33/18.1; 33/1 M

[58] Field of Search ..... 33/18.1; 220/82 R, 80; 73/330, 331

[56] References Cited

U.S. PATENT DOCUMENTS 2,172,864 9/1939 Calva et al. ..... 220/82 R 3,760,505 9/1973 Clark ..... 33/18.1

*Primary Examiner*—Harry N. Haroian

*Attorney, Agent, or Firm*—Michael Ebert

[57] ABSTRACT

A toy drawing device in which a window in a housing containing powder is covered by a glass plate whose edges are received within a groove in a sectioned rim joined to a window frame to prevent leakage of powder therefrom. A mobile stylus under the control of an operator acts to trace lines on a layer of powder adhering to the undersurface of the glass plate. To prevent injuries should the glass plate break, its outer surface is shielded by a transparent protective film formed of heat-formable, synthetic plastic material.

3 Claims, 1 Drawing Sheet

DRAWING DEVICE HAVING MOBILE STYLUS TRACING LINES ON GLASS PLATE

BACKGROUND OF INVENTION

1. Field of Invention

This invention relates generally to a drawing device having a mobile stylus adapted to draw or trace on the undersurface of a glass plate rendered opaque by powder, various line drawings or sketches whose contours depend on the operator-controlled path taken by the stylus as it scrapes powder from the glass plate, and more particularly to a drawing device of this type in which the glass plate is so framed as to prevent the leakage of powder from the device, the glass plate being protectively shielded by a transparent rigid or semi-rigid film of heat-formable material.

2. Status of Prior Art

French Pat. No. 1,242,870, and the Grandjean U.S. Pat. No. 3,305,113, as well as the Clark U.S. Pat. No. 3,760,505, disclose a tracing device having educational as well as play value. The tracing device includes a box-like case having a transparent top glass plate or screen next to which are left and right control knobs. By turning these knobs, one can delineate on the screen by means of a mobile stylus various letters, charts, designs and other line drawings and sketches.

In a drawing or tracing device of this type, in order to form a horizontal line on the X-direction on the screen, the operator has only to turn the left knob, while to form a vertical line in the Y direction, he turns the right knob. And to create curves and angles on the screen, these knobs are turned at the same time, thereby causing the stylus to move in a path which is the vector resultant of the X and Y movements.

The case is partly filled with a slightly adhesive powder which sticks onto the undersurface of the screen to render it opaque but is easily dislodged therefrom. The undersurface of the screen is engaged by the mobile stylus which under knob control scrapes the powder from the screen to define a line whose contour depends on the operator-controlled path taken by the stylus.

To erase the line drawing or sketch defined by the scraped-off powder on the screen, the case is turned upside down and is shaken to cause the powder to cascade over the undersurface of the screen, to again form an opaque coating.

The fragility of the glass plate is a potential danger, especially for children. For this reason, safety standards dictate the use of a protective film made of synthetic material to cover the outside of the glass plate.

In order to shield the glass plate, the above-identified Clark patent imprisons a flexible plastic film under an outer frame which is joined to the housing of the tracing device and surrounds the window. It is difficult, however, especially in large scale production of such drawing devices, to place this flexible film in its proper position and to fix it in place without at the same time creasing the film. Such creasing interferes with the optical properties of the drawing device.

Another drawback of the drawing device disclosed in the Clark patent is that in order to prevent leakage of the powder from inside the device, a non-hardening adhesive must be applied between the marginal surface of the glass plate and an inner liner or side wall support therefor which includes a groove for the adhesive. These expedients add to the production difficulties and the costs entailed in large scale manufacture of the drawing device.

SUMMARY OF INVENTION

In view of the foregoing, the main object of this invention is to provide a drawing device having a protective film which can easily be mounted over the glass plate and which has excellent inherent flatness so as not to disturb the optical properties of the plate.

More particularly, an object of this invention is to provide a protective film of the above type which is of rigid or semi-rigid film made of heat formable material.

Also an object of this invention is to provide a drawing device wherein to prevent leakage of powder therefrom, the window of the housing is covered by a glass plate whose edges are received within a groove formed in a rim molded about the edges, the rim being joined to an intermediate frame.

The housing and the protective film preferably comprise complementary sections for positioning the film with respect to the housing. In an advantageous embodiment, these complementary sections comprise at least one projecting rim on the external surface of the housing around said window, and a section corresponding to this rim, heat-formed in the protective film. The protective film may be fixed to the housing on the side of the rim which is opposite the window.

In a preferred embodiment, the housing comprises an intermediate frame made of synthetic material to which the glass plate is fixed by means of a sectioned part made of synthetic material, molded onto the respective edges of the glass plate and of the intermediate frame, this sectioned part forming said rim. The device preferably comprises an external frame provided with a groove fitting on the rim and on the corresponding section of the protective film.

Briefly stated, these objects are attained in a toy drawing device in which a window in a housing containing powder is covered by a glass plate whose edges are received within a groove in a sectioned rim joined to a window frame to prevent leakage of powder therefrom. A mobile stylus under the control of an operator acts to trace lines on a layer of powder adhering to the undersurface of the glass plate. To prevent injuries should the glass plate break, its outer surface is shielded by a transparent protective film formed of heat-formable, synthetic plastic material.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
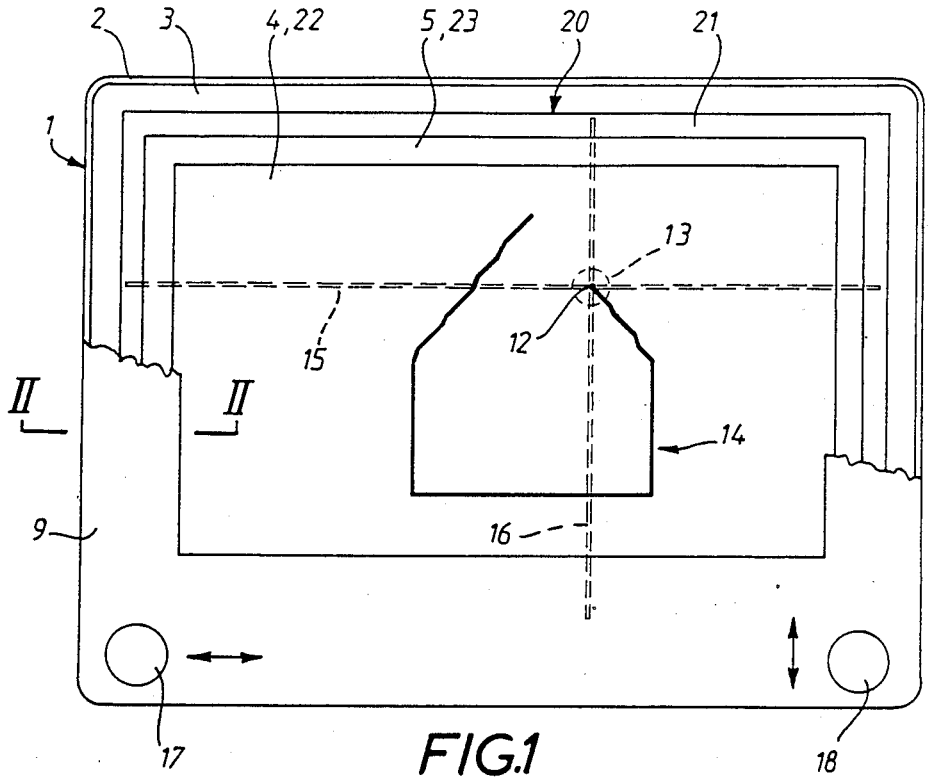
FIG. 1 is a diagrammatic plan view of a toy drawing device in accordance with the invention.
Figure 2:
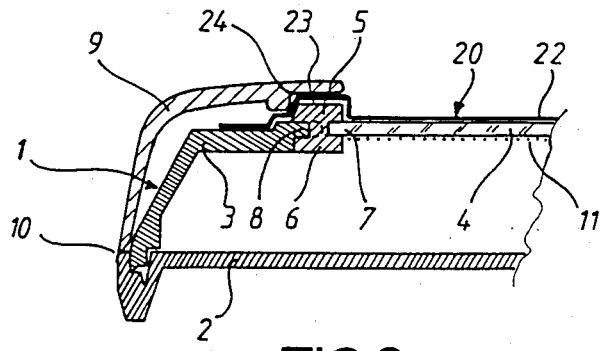
FIG. 2 is an enlarged view of a cross section of a part of the drawing device, taken in the plane indicated by line II—II in FIG. 1.

With reference to FIGS. 1 and 2, the device shown comprises a sealed housing 1 formed by a lower or base part 2 intended to be put on a horizontal surface, an upper part 3 ultrasonically welded onto the periphery of the lower part and provided with a central rectangular window, and a glass plate 4 fixed to housing part 3 so as to cover this window.

Parts 2 and 3 of the housing are made of a darkcolored thermoplastic material. Part 3 is provided around the perimeter of the window with an external rim 5 which, in this embodiment, is formed by a sectioned part 6 molded onto edge 7 of the glass plate and onto an internal edge 8 of part 3. Thus, the edges of the glass plate are received within a groove formed in sectioned part 6, so that no powder can escape from the housing. In practice, part 6 is insert molded about the glass plate.

In fact, part 3 is an intermediate frame which will be concealed by an external frame 9 made of colored thermoplastic material, this frame being welded at 10 to the lower part 2 of the housing and extending above rim 5 to give a good appearance. External frame 9 is partially cut away in FIG. 1 to expose the other components of the drawing device.

Housing 1 contains a colored powder which, once it has been spread out against glass plate 4 by upturning the housing, tends to remain applied against the inner surface of this plate by forming an opaque layer 11 in which lines can then be traced by moving the point 12 of a stylus 13 against the glass plate. The point of the stylus detaches powder from the glass plate as it moves, and this appears as a dark line in the layer of light-colored powder. The game consists in moving stylus 13 along two rectangular coordinates so as to trace a suitable drawing 14. For this purpose, stylus 13 is formed by a part made of synthetic material mounted so as to slide on two orthogonal metal bars 15 and 16 which are moved independently and parallel to themselves inside the housing, thanks to two devices having wires and pulleys controlled by two respective rotating knobs 17 and 18 keyed to axles emerging from the housing. These devices are well known and will not therefore be described in further detail.

To prevent any risk of injury should there be an accidental breakage of glass plate 4, the plate is covered externally with a transparent protective film 20 made of heat-formable, semi-rigid synthetic material, for example, PVC. This film is preferably applied against the outer surface of glass plate 4. Its dimensions are greater than those of the window, so that it extends above rim 5 and comprises a flat external edge 21 applied to a corresponding plane surface of the intermediate frame 3. Film 20 is worked by heat-forming so as to have a plane central part 22 opposite the window, surrounded by a groove 23 having substantially the same cross section as rim 5 of the housing, so as to fit exactly on said rim when film 20 is placed on the housing. It also comprises two holes fitting on the respective axles of knobs 17 and 18.

When the device is manufactured, once glass plate 4 has been fixed in the intermediate frame 3, the semi-rigid protective film 20 may easily be laid down onto the housing by mechanical means and be centered automatically by fitting it onto rim 5. Then it is possible to fix it to the housing along its flat edge 21, for example, by a bonding agent or by ultrasonic welding, but this is not necessary in the preferred embodiment described herein. In fact, thanks to its section in groove 23, it is then locked on rim 5 by a corresponding groove 24 of external frame 9.

While there has been shown and described a preferred embodiment of a drawing device having mobile stylus tracing lines on glass plate in accordance with the invention, it will be appreciated that many changes and modifications may be made therein without, however, departing from the essential spirit thereof.

I claim:

1. A toy tracing device comprising:

A a housing constituted by an upper part and a lower part, the upper part having an opening therein bordered by a frame to define a window, said housing containing a charge of slightly adhesive powder sufficient to form an opaque layer on the undersurface of the plate;

B a glass plate covering the window, the edges of the plate being received within a groove formed in a rim surrounding the plate and joined to the frame, thereby sealing the housing to prevent leakage of powder therefrom; said rim being molded about the glass plate, said groove being intermediate upper and lower sections of the rim;

C a stylus movable within the housing and engaging the undersurface of the glass plate to trace lines in said layer of powder adhering thereto; and D a transparent protective film made of relatively rigid, heat-formable, synthetic plastic material shielding the outer surface of the plate to prevent injuries should the plate break; said film having a margin extending beyond the plate and formed to conform to the upper section of the rim so that the film fits exactly on the rim, said housing including an outer part which overlies the upper part and has an opening therein bordered by an outer frame which overlies the margin of the film, whereby this margin is trapped between the outer frame and the rim.

2. A device as set forth in claim 1, wherein said film is formed of polyvinyl chloride.

3. A device as set forth in claim 1, wherein said parts are rectangular and are formed of synthetic plastic material.

* * * * *